United States Patent [19]

Hristozov et al.

[11] Patent Number: 4,609,108

[45] Date of Patent: Sep. 2, 1986

[54] TOBACCO SORTING METHOD AND APPARATUS

[75] Inventors: Vladislav N. Hristozov, Sofia; Hristo M. Ribarov, Plovdiv; Zdravko B. Marchev, Sofia; Spas N. Markov, Plovdiv; Atanas A. Valev, Sofia, all of Bulgaria

[73] Assignee: Institute Po Technicheska Kibernetika I Robotika, Sofia, Bulgaria

[21] Appl. No.: 574,705

[22] Filed: Jan. 27, 1984

[51] Int. Cl.[4] ..... B07C 5/342

[52] U.S. Cl. ..... 209/581; 198/453; 198/493; 209/639; 209/905; 209/906; 271/309

[58] Field of Search ..... 209/576, 577, 580, 581, 209/582, 587, 639, 644, 557, 905, 906; 198/493, 453, 689; 271/121, 197, 199, 309

[56] References Cited

U.S. PATENT DOCUMENTS

| | | | |
|---|---|---|---|
| 3,770,112 | 11/1976 | Asfour | 209/580 |
| 3,854,586 | 12/1974 | Perkins, III | 209/581 |
| 3,939,983 | 2/1976 | Asfour | 209/581 |
| 4,308,959 | 1/1982 | Hoover et al. | 209/587 |

FOREIGN PATENT DOCUMENTS

| | | | |
|---|---|---|---|
| 1044719 | 12/1978 | Canada | 271/309 |
| 0130420 | 10/1980 | Japan | 198/453 |

*Primary Examiner*—Randolph A. Reese
*Assistant Examiner*—Donald T. Hajec

[57] ABSTRACT

Method of and apparatus for sorting tobacco into two groups: a group of satisfactory leaves and a group of unsatisfactory leaves. Tobacco leaves, spaced so that they pass one by one along a conveyor, travel through a zone illuminated by pulsed polychromatic light and an optical sensor receiving light reflected from the tobacco leaves. In a manner which is synchronous with the pulsations of light there is measured the quantity of the light reflected by each of the leaves in the green, orange, red, and infrared areas of the spectrum. Sums are formed from the values corresponding to the reflected light in such areas of the spectrum and relations are obtained between sums corresponding to the green and orange as well as to the red and infrared ranges, of time in which the value of the reflected light in the infrared area is greater than a value preliminarily preset by the operator. When in such time a number of measurements greater than the preset value is reached or when the relations of the sums are outside preset limits, a decision is made to eliminate the leaves which give rise to such measurements. The apparatus eliminates all but a single layer of longitudinally spaced tobacco leaves thereon, and removes the leaves from the conveyor and blows them in virtually free travel through the air to a sorter in the form of a pneumatic unit.

2 Claims, 3 Drawing Figures

TOBACCO SORTING METHOD AND APPARATUS

Figure 1:
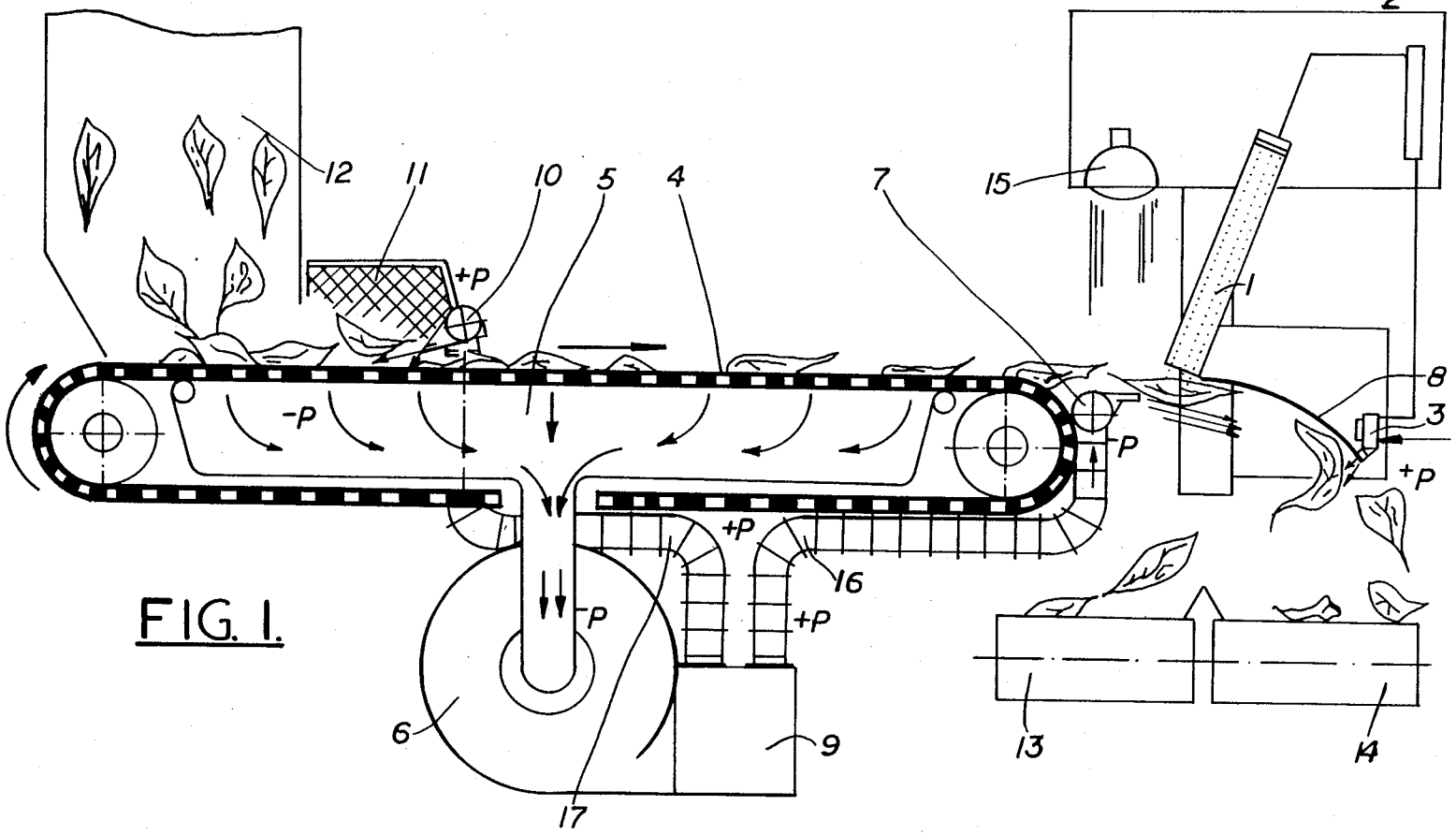

This invention relates to a method of and an apparatus for sorting tobacco; the invention may be used to advantage in the automation of the industrial treatment of tobacco.

U.S. Pat. No. 3,854,586 discloses a method for the sorting of tobacco into two groups in which the tobacco leaves are passed in front of an optical sensor and are illuminated by a polychromatic light. The quantity of light reflected by the sorted leaves is measured in a synchronous manner with the pulsations of light in the green, orange, red and infrared areas of the spectrum. Between the values of the reflected light corresponding to the green, orange or red and infrared areas there are formed relations, and in the case of relations outside predetermined limits set in advance a decision is taken to eliminate the leaves by means of a pneumatic block. A drawback of such known method is that in the case in which a leaf with large dimensions and a non-uniform coloring passes through the zone of the optical sensor, it is impossible to carry out an integral estimation of its pertinence to one of the two groups of leaves, and further, the dimensions of a leaf is not taken into account so that its sorting is of little value.

U.S. Pat. No. 3,770,112 discloses an apparatus for sorting tobacco leaves that comprises a vibrating conveyor transmitting to the external side of a vertically traveling zone of an endless perforated transporting belt. There is thus created at the inner side of said zone an area underpressure that is connected with the suction opening of a ventilator. The optical block for classifying the tobacco leaves is disposed over the horizontal part of the conveyor, and is connected with a pneumatic block disposed at the inner side of the vertically falling area of the transporting belt. Such belt consists of several zones for acting with underpressure on the tobacco leaves, depending upon the decision of the classifying unit containing photosensors and an electronic block.

A drawback of the known apparatus is the probability of superimposition of two or more leaves one upon the other because of counting and relying only upon the gravitational forces for their separation, such gravitational forces being sometimes weaker than the forces of adhesion between the leaves. On the other hand, it is not possible to assess precisely the tobacco leaves by the optical classifying unit, since the conveyor belt on the background of which the estimation is carried out substantially changes its optical parameters depending upon pollution and dust in the relevant area. Finally, the technical carrying out of the method is very complicated, due to the necessity of creating an underpressure throughout a large area and volume which are in contact with movable mechanical parts.

An apparatus is known for the sorting of tobacco leaves in two groups comprising an optical electronic block for leaf classifying, the vision zone of which is disposed on the expected trajectory of passing of the tobacco leaves; this block is connected with a pneumatic block disposed over the expected trajectory.

A drawback of this known apparatus is the probability of errors arising in the sorting of tobacco leaves, due to the great dependence of the balistic trajectory of the tobacco leaves on their dimensions, humidity, weight, and form.

The present invention has among its objects the provision of a method of and an apparatus for sorting tobacco into two groups, whereby all tobacco leaves are sorted completely, precisely, with an accelerated action and by means of simplified devices.

This object is accomplished by a method for sorting tobacco in two groups wherein every tobacco leaf passes before an optical sensor and is illuminated with a polychromatic light. In a synchronous manner with light pulsations, there are measured the values of the light reflected by the leaves in the green, orange, red, and infrared areas of the spectrum.

Within the range of values corresponding to the reflected light in the red and infrared range, and also in the green and orange ranges, there are values in a given period of time in which the values of the measured light reflected by the leaves in the infrared range are greater than a preset value predetermined by the operator. The reflected light measurements within said period of time are counted, and in the case of a number greater than the value preset by the operator, or when the proportion of the corresponding sums of such values are outside the preset limits, a decision is made to eliminate the tobacco leaves which give rise to such measurements. This decision causes and elimination of such leaves after a predetermined delay preset by the operator. Such delay is recorded from the moment in which the value of the light reflected in the infrared range becomes lower than the preset value.

The invention also includes the provision of an apparatus for the sorting of tobacco leaves, such apparatus comprising an optical sensor connected to an electronic block, the output of which is connected with a pneumatic block and a conveyor with a perforated belt beneath the upper portion of which there is a zone with sub-atmospheric pressure connected with the suction opening of the ventilator. The pneumatic block is disposed in such way that the tobacco leaf enters the zone of its action after the value of the light reflected in the infrared range has diminished below the preset value. Between the end of the transport belt and the effective zone of vision of the optical sensor there is disposed a first elongated air nozzle spanning the conveyor and oriented in the direction of movement of the upper portion of the transport belt. Between the zone of vision of the optical sensor and the pneumatic block there is disposed a flexible screen. The outlet opening of the ventilator or fan is connected through a flow stabilizer to the above-described air jet. Above the conveyor belt there is disposed a second elongated air jet which also spans the top run of the conveyor and is also connected to the air flow stabilizer. Such nozzle blows air in the direction opposite the direction of movement of the upper run of the conveyor. In order to improve the operation of the apparatus, it is advantageous to dispose a buffer leaf receiving receptacle before the second air jet.

The advantages of the invention are that all leaves of tobacco are completely sorted, precisely, with a fast action and a simplified apparatus. The leaves are transmitted separately for evaluation by the electronic block without overlapping, and they are not disbursed beneath the conveyor belt.

In addition, there is also secured a stabilized trajectory of passage of the tobacco leaves through the zone of vision of the electronic block independently of the dimensions, humidity, weight and form of the tobacco leaves. Another advantage of the invention is that it presents the possibility of regulating the position of the pneumatic block over a wide range.

Figure 2:
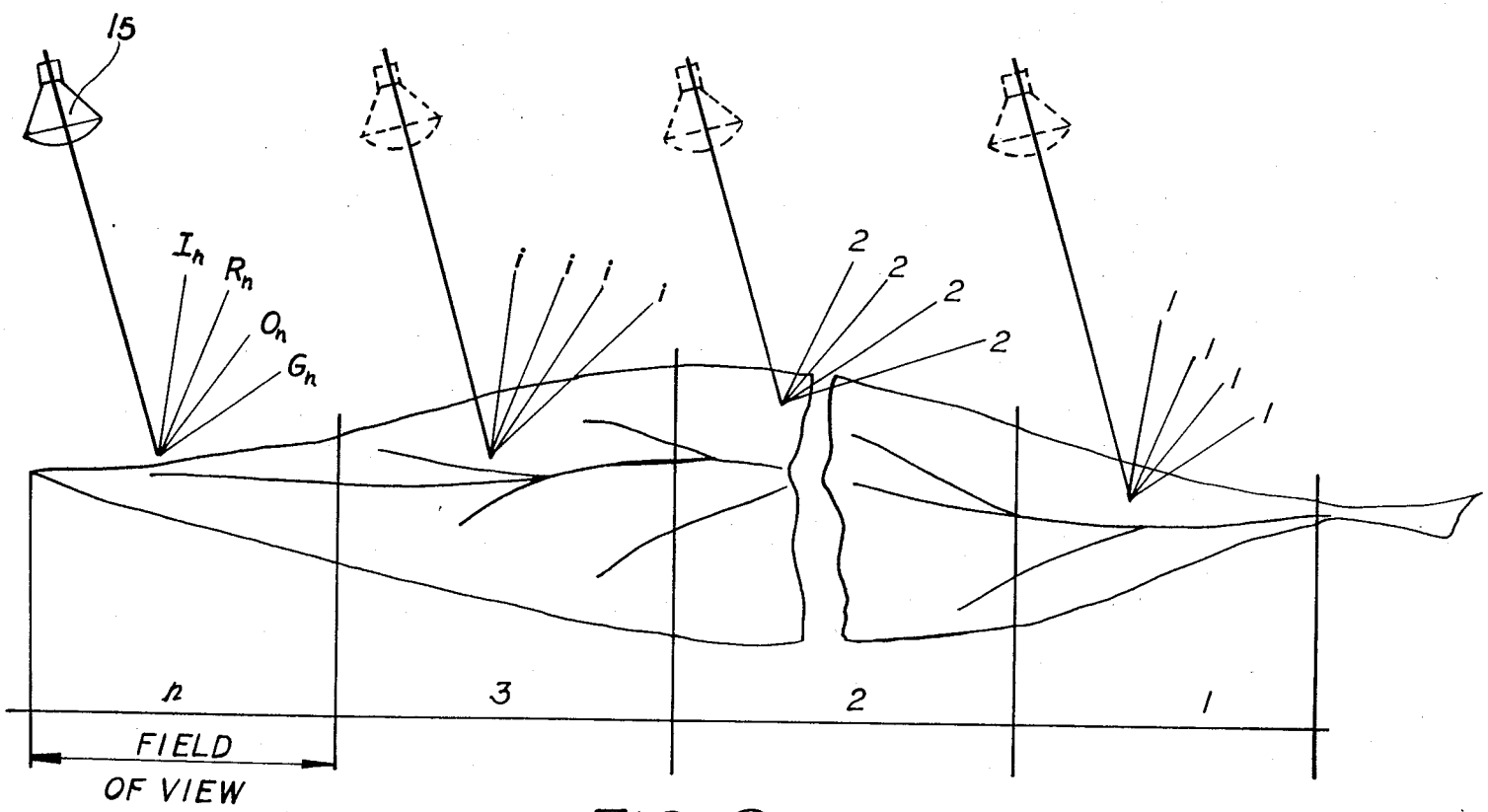
Figure 3:
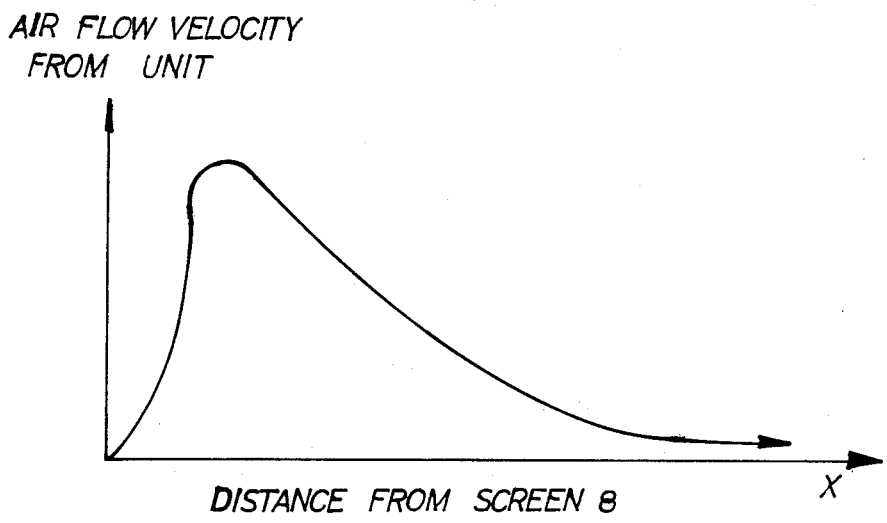

For a better understanding of the invention, and to explain how the same may be carried into effect, reference will now be made, by way of example, to the accompanying drawings, in which:

FIG. 1 is a view partially in vertical longitudinal section and partially in side elevation of a preferred embodiment of the apparatus of the invention;

FIG. 2 is a schematic view illustrating the successive phases of passage of a tobacco leaf through the zone of vision of the apparatus, a single leaf being shown traveling to the right, in the same direction as in FIG. 1, and as having passed through successive zones of vision 1, 2, 3, and n corresponding to first, second, third, and nth measurements; and FIG. 3 is a graph showing the relationship between the air flow velocity from the first air nozzle of the apparatus and the distance from the flexible screen thereof.

Turning first to FIG. 1, the apparatus comprises an optical sensor 1 connected to an electronic unit 2 the output of which is connected to a pneumatic unit 3. The apparatus has an endless belt conveyor with a perforated belt 4 the upper run of which travels from left to right; beneath the upper horizontal run of belt 4 there is provided a sub-atmospheric pressure zone 5 connected with the suction opening of a fan 6. Between the discharge or righthand end of the conveyor belt 4 and the zone of vision of the optical sensor 1 there is disposed a first elongated air jet spanning the upper run of the conveyor, jet 7 having a discharge opening pointed in the direction of movement of the upper run of the conveyor belt 4. Between the vision zone of the optical sensor 1 and the pneumatic block 3 there is disposed a flexible diaphragm or screen 8. The pneumatic unit 3 variably produces an air stream upon command, so as selectively to direct tobacco leaves onto a conveyor 14 for satisfactory leaves, and to direct rejected leaves to a conveyor 13.

Above the upper run of the conveyor belt 4 there is disposed a second elongated air jet 10 spanning the upper run of belt 4, the outlet opening of jet 10 being directed opposite to the direction of movement of the upper run of the conveyor belt 4. Jet 10 is connected with a flow stabilizer 9 by a conduit 17; the above-described first jet 7 is also connected to the air flow stabilizer 9, in this case by a conduit 16. Said stabilizer is connected to the outlet opening of fan 6. Upstream of the jet 10 there is a container 11 having walls in the form of nets, container 11 providing a buffer volume of tobacco leaves which are fed from a bin 12 onto the upper run of the perforated conveyor belt 4. Illuminating unit 15, emitting light with an intensity varying in periods due to the supply of this unit with a low frequency alternating current, is disposed to illuminate the zone of vision of the optical sensor 1 and the leaves being shot therefrom to pass under the flexible screen 8 and to be selectively directed by the pneumatic unit 3 onto the selected conveyor 13 or 14.

MANNER OF OPERATION OF THE APPARATUS

Tobacco leaves fed from the bin 12 to the upper run of the perforated belt 4 adhere to the upper run of such belt only at the zone of perforations therein. The leaves which land at other spots on the conveyor are blown away from the surface of the conveyor by the jet 10 and thus temporarily deposited in the receptacle 11 providing a buffer volume of tobacco leaves. The leaves which adhere to the upper surface of the belt 4 by reason of the sub-atmospheric pressure existing in the zone 5 beneath such run of the belt are carried thereby to the right as shown in FIG. 1. The perforations through the belt 4 are located in groups with a predetermined distance between them so that overlapped leaves are not adhered to or travel with the belt 4 to the right. The leaves eliminated by the jet 10 are retained in the buffer container 11 until they arrive on an unoccupied perforated field on the belt 4. The air stream created by the jet 7, at the righthand end of the conveyor 4, carries the leaves from the upper run of the conveyor belt 4 through the zone of vision of sensor 1 to the pneumatic unit 3. The zone of vision illuminated by the light source 15 is such as the zone in which tobacco leaves, after having left the belt 4, travel toward the flexible screen 8.

The amounts of the light reflected by the tobacco leaves in the various areas of the spectrum are shown in FIG. 2. The green area of the spectrum is designated G, the orange area of the spectrum is designated O, the red area of the spectrum is designated R, and the nearby infrared range of the spectrum is designated I. All of such zones of the spectrum of light reflected by the tobacco leaves are measured by the optical sensor 1. Only for one of these areas of the spectrum, the infrared, is there is a characteristic permanent coefficient of reflection which is pertinent to all tobacco leaves independently of their origin, kind, and quality.

Such optical measurements of reflected light in the various areas of the spectrum are effected periodically in a manner which is in synchronism with the pulsation of light emitted from the illuminating unit 15, which as we have seen above, is supplied with low frequency alternating current. Each such measurement checks whether the amount of reflected light in the infrared range of the spectrum, which is invariable with respect to the quality of the tobacco, surpasses a preset predetermined value. Within the period of time in which the measured value $I_i$ of the light reflected by the leaves in the infrared range of spectrum exceeds the preset predetermined value, the afore-mentioned measured values $G_i$, $O_i$, $R_i$ and $I_i$ is recorded. In FIG. 2 there is schematically shown the making of such measurements in an unspecified number 1–n, inclusive. When the amount of light reflected in the invariable area of the spectrum no longer exceeds the preset value, the number of measurements in such time span is ascertained to see whether or not it is greater than the predetermined preset number thereof. If the number of measurements taken is greater than such preliminarily preset number, a decision is made to eliminate the particular leaf which has been thus inspected from the basic stream of leaves, that is, such particular leaf is directed by the appropriate air stream by pneumatic unit 3 so that rejected leaves would fall upon the conveyor 13 and satisfactory leaves would fall upon the conveyor 14.

The velocity of the air stream from the jet 7 in the direct neighborhood of the flexible screen 8 is smaller than the velocity of the basic air stream. The dependency of the velocity "V" of the air stream upon the distance "X" to the flexible screen 8 is shown in FIG. 3. The pressure of the air in the layer having the highest speed is the lowest, thus leading to the returning of the leaves passed through the zone of vision of the optical sensor in that layer. As a result, the leaves follow a trajectory repeating the form of the flexible screen 8 without causing any appreciable if any frictional forces to arise between the screen and the falling tobacco leaves. At the end of the flexible screen 8 there is disposed the zone of action of the pneumatic unit 3, which, depending on the decision of the electronic unit 2, selectively acts or does not act on the tobacco leaves passing by such unit. The rejection of unwanted tobacco leaves takes place with a predetermined advance preset delay with respect to the moment at which the amount of light reflected in the spectrum zone which is invariable with respect to the quality of the tobacco leaves stops to surpass the predetermined preset value. The leaves on which there is applied the respective action, arrive at the leading away conveyor line 13 and the other leaves travel along another conveyor line 14 leading away from the zone of action. The air, led off from the zone 5 by the fan 6, is fed through the air flow stabilizer 9 to the jets 7 and 10, as has been explained above.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. Apparatus for sorting tobacco leaves, comprising a perforated belt conveyor, means providing a zone of sub-atmospheric pressure beneath the upper run of said conveyor belt, a source of polychromatic light illuminating a zone of vision through which tobacco leaves travel in sequence, said source emitting light, which varies its intensity periodically due to supplying said source with low frequency alternating current and having green, orange, red, and infrared areas of the spectrum, and an optical sensor receiving light reflected to the sensor from the tobacco leaves, a pneumatic unit which separates in a zone of action the successive tobacco leaves which have thus been inspected by the light source and the optical sensor to divide such tobacco leaves into a satisfactory group and an unsatisfactory group, between the zone of vision of the optical sensor and the zone of action of the pneumatic unit there is a distance insuring the entering of the tobacco leaf in the zone of action of the pneumatic unit after the value of the light reflected in the infrared range has diminished to a value below the preliminary preset value, between the vision zone of the optical sensor and the zone of action of the pneumatic unit there is disposed a flexible screen, between the discharge end of the conveyor belt and the zone of vision of the optical sensor there is disposed a first air jet which is oriented in the direction of movement of the upper run of the conveyor belt and a second jet disposed above the upper run of the conveyor belt, said second jet being oriented in a direction opposite to the upper run of the conveyor belt, the two jets being connected via a flow stabilizer to a source of super-atmospheric air pressure.

2. Apparatus according to claim 1, wherein upstream of the second jet, which is directed contrary to the direction of movement of the upper portion of the conveyor belt, there is disposed a porous walled container for temporarily receiving and holding tobacco leaves which are blown from the conveyor belt, whereby leaves are deposited upon and travel with the conveyor as a single layer of spaced individual tobacco leaves.

* * * * *